US011905577B2

(12) United States Patent
Huang et al.

(10) Patent No.: US 11,905,577 B2
(45) Date of Patent: Feb. 20, 2024

(54) MAGNESIUM ALLOY FOR WHEEL AND PREPARATION METHOD THEREOF

(71) Applicant: CITIC Dicastal Co., Ltd., Qinhuangdao (CN)

(72) Inventors: Lixin Huang, Qinhuangdao (CN); Zuo Xu, Qinhuangdao (CN); Meng Li, Qinhuangdao (CN); Tieqiang Chen, Qinhuangdao (CN); Hanqi Wu, Qinhuangdao (CN); Qingzhu Zhang, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 69 days.

(21) Appl. No.: 17/576,239

(22) Filed: Jan. 14, 2022

(65) Prior Publication Data

US 2023/0074156 A1 Mar. 9, 2023

(30) Foreign Application Priority Data

Sep. 3, 2021 (CN) ..... 202111031332.2

(51) Int. Cl.

| | |
|---|---|
| ***C22C 1/02*** | (2006.01) |
| ***C22C 23/02*** | (2006.01) |
| ***B21J 1/06*** | (2006.01) |
| ***B21K 1/40*** | (2006.01) |

(52) U.S. Cl.

CPC ..... *C22C 1/02* (2013.01); *B21J 1/06* (2013.01); *B21K 1/40* (2013.01); *C22C 23/02* (2013.01)

(58) Field of Classification Search

CPC ..... C22C 23/02

See application file for complete search history.

(56) References Cited

FOREIGN PATENT DOCUMENTS

| | | | |
|---|---|---|---|
| CN | 1425785 | A | 6/2003 |
| CN | 102787264 | A | 11/2012 |
| CN | 106834766 | A | 6/2017 |
| CN | 109182861 | A | 1/2019 |
| WO | 2006136065 | A1 | 12/2006 |

*Primary Examiner* — Alexandra M Moore

(74) *Attorney, Agent, or Firm* — IPro, PLLC

(57) ABSTRACT

The disclosure discloses a magnesium alloy for wheels, comprising in mass percentage: Al: 2-3.0 wt. %; Zn: 0.5-1.0 wt. %; Mn: 0.3-0.5 wt. %; Ce: 0.15-0.3 wt. %; La: 0.05-0.1 wt. %, the balance is Mg. The magnesium alloy of the present invention takes Al element and Mn element as main alloying elements, supplemented by trace Ce and La elements as alloying process, and the nano-scale Mn-rich precipitated phase obtained during homogenization and the segregation of rare earth elements Ce and La at the interface and grain boundary of Mn-rich precipitated phase are used to inhibit the coarsening during extrusion and forging, so as to improve the strength and plastic deformation ability of the alloy.

7 Claims, 3 Drawing Sheets

MAGNESIUM ALLOY FOR WHEEL AND PREPARATION METHOD THEREOF

TECHNICAL FIELD

The present invention relates to the field of metal materials and metal material processing, in particular to a spun magnesium alloy with low cost and a preparation method thereof.

BACKGROUND

As we all know, the magnesium density is about 1.74 g/cm$^3$, which is ⅔ of aluminum and ¼ of steel. Among many metals, magnesium alloy is the lightest metal structural material available so far, and has advantages of high specific strength and rigidity, shock absorption, electromagnetic shielding and radiation resistance, easy cutting processing and green recycling. It has broad application prospects in automobile, electronics, electrical appliances, transportation, aerospace and other fields. It is a lightweight metal structural material developed after steel and aluminum alloy, and can also be developed into functional materials such as biomedical materials and air batteries, and is known as a green engineering material in the 21st century.

At present, Mg—Al alloys are mainly commercial alloys such as AZ31, AM60, AZ61, AZ80 and AZ91, which have become the most widely used commercial magnesium alloys.

However, magnesium has to be machined and deformed at higher temperature because its closely packed hexagonal crystal structure is not as plastic as that of face-centered cubic or body-centered cubic mechanism slip system at <200° C. Magnesium alloys have low strength and plasticity at room temperature, and it is difficult to give attention to both, which restricts the wide application of magnesium alloys. However, increasing the processing temperature not only tends to coarsen grains and reduce the overall mechanical properties of materials, but also further increases the processing cost. Therefore, the development of magnesium alloy materials with excellent formability at room temperature or lower temperature can greatly promote the wide application of magnesium and its alloys in automobile, rail transit, aviation and other fields, and has important practical significance for expanding the application fields of magnesium alloys.

In recent years, a great deal of research work has been done to prepare magnesium alloys with high room temperature plasticity by various methods, and some magnesium alloys with high room temperature plasticity have been reported one after another at home and abroad. Application Publication number CN101381831A providers a high plasticity magnesium alloy, which contains 80-83% of magnesium, 12-15% of zinc and 2-8% of zirconium, 23-27% of lithium by mass, 7-9% of manganese by mass and 4-6% of yttrium by mass. By smelting, heat treatment and extrusion, the elongation of the alloy at room temperature is 42-49%. However, the alloy contains a large amount of lithium, so it is necessary to vacuumize or pass argon protection first in the smelting process, and meanwhile strictly control the oxygen content; on the other hand, there are a lot of rare earth elements yttrium and lithium in the alloy, which makes the alloy expensive.

The patent of application publication number CN102925771A provides a magnesium alloy material with high room temperature plasticity and a preparation method thereof: Li: 1.0-5.0%, Al: 2.5-3.5%, Zn: 0.7-1.3%, Mn: 0.2-0.5%, impurities 0.3%, and magnesium as the balance. Pure lithium and AZ31 magnesium alloy were melted under vacuum and inert gas. The elongation of the alloy is 14%-31% at room temperature. Similarly, the smelting process of the alloy is complex, and the overall room temperature elongation is still low. The patent of application publication number CN102061414A provides a high plastic magnesium alloy and a preparation method thereof. The composition of the magnesium alloy is: Al: 0.5-2%, Mn: 2%, Ca: 0.02-0.1%, the balance is magnesium, and the room temperature elongation of the magnesium alloy can reach 25%. Although the cost of the alloy is low, the elongation is still low. These existing inventions with high room temperature plasticity still provide low room temperature plasticity. In order to better meet the requirements of low cost, easy processing and high performance of high strength magnesium alloy in various industries, there is an urgent need to develop magnesium alloy materials with excellent room temperature plasticity prepared by simple production and processing process, which will greatly expand the advantages of abundant magnesium reserves in China and have great national economic and social significance.

At present, forged magnesium alloy wheel hubs are often manufactured by traditional forging process, in which spokes and wheel rims are obtained by forging process. However, the traditional forging process needs super-large tonnage forging equipment, result in high processing risk, large metal loss and high cost. Using forging and spinning process can greatly improve the metal utilization rate and reduce the tonnage of forging equipment. The wheel rim part in forging and spinning process is formed by spinning process. Because the die is not easy to heat in spinning process, even if the forging blank of magnesium alloy is heated in advance, it will still lose a lot of heat in the spinning process, so the spinning process requires high low temperature formability of magnesium alloy. At present, ZK30 magnesium alloy, which has excellent spinning performance at low temperature, has high preparation cost due to the addition of Zr element. Therefore, there is an urgent need for a low-cost magnesium alloy which can be spun at low temperature and has excellent mechanical properties.

SUMMARY

In view of this, the present invention aims to provide a magnesium alloy for wheels and a preparation method thereof, which enables the magnesium alloy to have good low-temperature spinning performance (temperature <360° C.) and excellent strength and plasticity after molding. Meanwhile the content of light rare earth is low, the cost of the raw materials and processing is low, and it is easy to realize mass production.

A magnesium alloy for wheels, comprising: Al: 2-3.0 wt. %; Zn: 0.5-1.0 wt. %; Mn: 0.3-0.5 wt. %; Ce: 0.15-0.3 wt. %; La: 0. 05-0.1 wt. %, the balance is Mg.

In some embodiments, unavoidable impurities are also included.

A method of preparing a magnesium alloy comprises the following steps: (1) batching, in terms of the mass percentage: Al: 2-3.0 wt. %; Zn: 0.5-1.0 wt. %; Mn: 0.3-0.5 wt. %; Ce: 0.15-0.3 wt. %; La: 0.05-0.1 wt. %, the balance is Mg for batching; (2) smelting, putting the pure Mg ingot into a crucible of a smelting furnace, setting the furnace temperature at 700-730° C. and keeping it, adding the pure Al block and pure Zn block preheated to 50-80° C. into magnesium solution after melting, then raising the smelting temperature to 760° C., adding Al—Mn master alloy, Mg—Ce—La master alloy and Mg—Ce master alloy preheated to 50-80° C. into magnesium solution respectively; then raising the smelting temperature to 780° C., keeping the temperature for 5-15 minutes, stirring for 3-10 minutes, introducing the high-purity Ar gas for refining and degassing, adjusting and controlling the temperature at 710° C.-730° C., and keeping the temperature for 2-10 minutes; (3) pouring, the pouring temperature is controlled above 680° C.; (4) stress-relief treatment, keeping the temperature at 280-320° C. for 8-12h, and then air cooling; (5) extruding and deforming, heating the stress-relieved magnesium alloy to 250-380° C. within 30 minutes, and then putting the magnesium alloy into a die for deforming; the extrusion speed being 1m/min-8m/min, and air cooling after deforming.

In some embodiments, the smelting process is carried out under the protection of a mixed gas of $CO_2$ and $SF_6$.

In some embodiments, after the smelting is completed, the surface scum needs to be removed and pour into a die to obtain a magnesium alloy.

In some embodiments, after the stress relief treatment, the processes of cutting into blanks and peeling are also included before extrusion.

In some embodiments, the stirring in the smelting process includes mechanical stirring and/or argon stirring.

In some embodiments, the Al—Mn master alloy is an Al-20Mn master alloy, the Mg—Ce—La master alloy is a Mg-15Ce-10La master alloy, and the Mg—Ce master alloy is a Mg-30Ce master alloy.

In some embodiments, a mixed gas of $CO_2$ and $SF_6$ has a composition volume ratio of 50-100:1.

A process for preparing a wheel according to the magnesium alloy includes the following steps: (1) forging on 6000-tons forging equipment; (2) spinning the wheel rim at 260° C.-360° C.

Compared with the prior art, the present invention has the following remarkable advances and advantages:

The magnesium alloy of the present invention takes Al and Mn elements as the main alloying elements, supplemented by trace Ce and La elements as alloying process. The nano-scale Mn-rich precipitated phase obtained during homogenization and the segregation of rare earth elements Ce and La at the interface and grain boundary of Mn-rich precipitated phase are used to inhibit the coarsening during extruding and forging, so as to improve the strength and plastic deformation ability of the alloy.

Magnesium alloy with high plastic deformation at room temperature is obtained, and magnesium alloy wheel hub is prepared by forging and spinning process. The tensile yield strength at room temperature of the wheel rim reaches 190 MPa, the tensile strength reaches 280 MPa, and the elongation is over 15.8%. At present, under the same forging and spinning conditions, wheel hub and wheel rim prepared by high-speed-extrusion commercial magnesium alloy AZ31 have the tensile yield strength of 133 MPa, the tensile strength of 242 MPa, and the tensile elongation at room temperature of only 8.7%.

2) The magnesium alloy of the present invention contains only a small amount of rare earth Ce and La, and the master AlMn alloy has low price and low alloy cost (the light rare earth Mg—Ce—La and MgCe master alloys are generally 35 to 50 RMB per kilogram, while the master AlMn alloy used in the present invention is only about 45 RMB per kilogram); in addition to being prepared into magnesium alloy wheel hubs, it can also be widely used to produce automobile parts such as window frames and seat frames; it can also be extruded into various types of materials as parts blanks in the aerospace field.

3) The magnesium alloy preparation process of the present invention is simple, breaks through the limitation of special processing modes such as large plastic deformation required by most high strength and toughness magnesium alloys, and the existing magnesium alloy extrusion equipment can continuously process and produce the magnesium alloy without additional improvement, and has low requirements on production equipment.

The prepared alloy has good high-temperature oxidation resistance, and can be poured and heat treated without protective gas under the condition of the present invention.

BRIEF DESCRIPTION OF THE DRAWINGS

The accompanying drawings, which form a part of the invention, serve to provide a further understanding of the present invention, and the illustrative embodiments of the present invention and the description thereof serve to explain the invention and are not unduly limiting. In the drawings.

DETAILED DESCRIPTION

Figure 1:
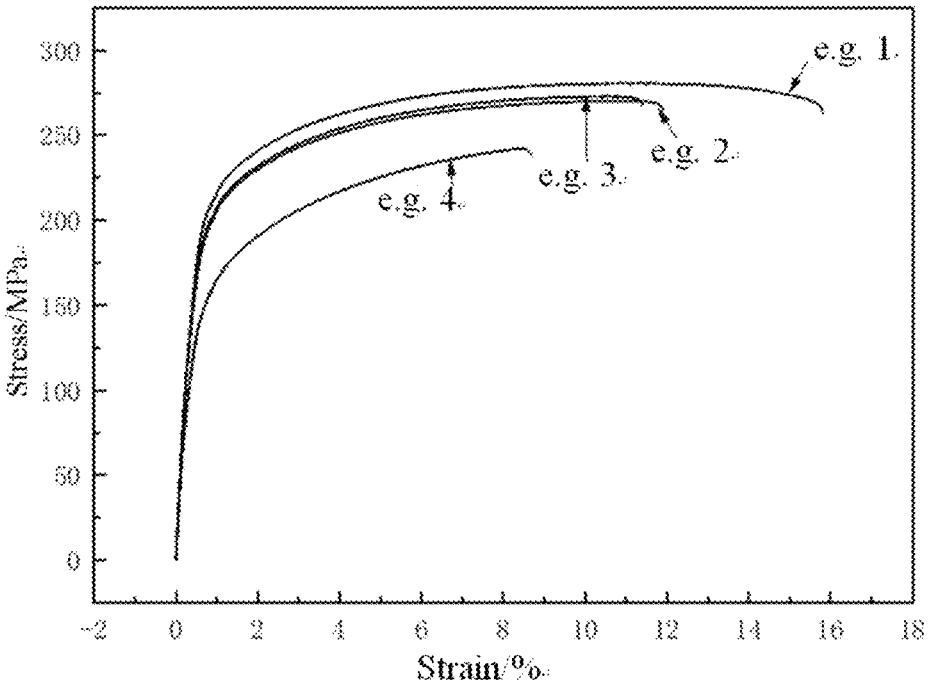
FIG. 1 is the stress-strain curve of the as-cast room temperature tensile test of the magnesium alloy of embodiments 1, 2 and 3 and comparative examples.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

A clear and complete description of the technical aspects of the present invention will be given below with reference to the accompanying drawings and in conjunction with embodiments. It will be apparent that the described embodiments are only part of and not all of the embodiments of the present invention. Based on the embodiments in the present invention, all other embodiments obtained by those skilled in the art without making creative efforts are within the scope of protection of the present invention.

The alloy is a new type of Mg—Al—Mn—La—Ce alloy with low aluminum, high manganese and light rare earth.

The technical solution of the present invention is: a magnesium alloy for wheels, the alloy is Mg—Al—Zn—Mn—La—Ce alloy, and the chemical composition mass percentage is: Al: 2-3.0 wt. %; Zn: 0.5-1.0 wt. %; Mn: 0.3-0.5 wt. %; Ce: 0.15-0.3 wt. %; La: 0.05-0.1 wt. %, the balance is Mg and unavoidable impurities.

A method for preparing the magnesium alloy comprises the following steps.

(1) Batching: using pure Mg ingots, pure Al blocks, pure Zn blocks, Al—Mn master alloys, Mg—Ce—La master alloys and Mg—Ce master alloys as raw materials, and batching according to the magnesium alloy composition.

(2) Smelting: putting the pure Mg ingot into a crucible of a smelting furnace, setting the furnace temperature at 700-

730° C. and keeping it, adding the pure Al block and pure Zn block preheated to 50-80° C. into the magnesium solution after melting, then raising the smelting temperature to 760° C., adding the AlMn master alloy, Mg—Ce—La master alloy and Mg—Ce master alloy preheated to 50-80° C. into magnesium solution respectively; then raising the smelting temperature to 780° C., keeping the temperature for 5-15 minutes, stirring for 3-10 minutes, introducing the high-purity Ar gas for refining and degassing, adjusting and controlling the temperature at 710° C.-730° C., and keeping the temperature for 2-10 minutes; the smelting process is carried out under the protection of a mixed gas of $CO_2/SF_6$.

(3) Pouring: removing the surface scum, pouring the magnesium alloy melt into corresponding die to prepare the as-cast magnesium alloy; the pouring temperature is controlled above 680° C. Gas protection is not required during pouring process.

(4) Stress-relief treatment: keeping the temperature at 280-320° C. for 8-12h, then air cooling; the heating and heat preservation process of stress-relieving treatment does not need gas protection.

The stress-relieving treatment ingot obtained in the previous step is cut into corresponding blank and peeled.

(5) Extruding and deforming: heating the blank obtained in the previous step to 250-380° C. within 30 minutes, and then putting into a die for deforming; extrusion speed is 1-8m/min, air cooling is carried out after deforming, and the plastic magnesium alloy material is finally obtained.

The stirring in the smelting is mechanical stirring or argon blowing stirring.

The Al—Mn master alloy is an Al-20Mn master alloy.

The Mg—Ce—La master alloy is a Mg-15Ce-10La master alloy.

The Mg—Ce master alloy is a Mg-30Ce master alloy.

The composition volume ratio of the mixed gas of $CO_2$ and $SF_6$ is 50-100:1.

A process for preparing a wheel according to the magnesium alloy comprises the following steps: (1) forging and spinning: forging the shaped magnesium alloy material described in the previous step on a 6000-ton forging equipment at a forging temperature of 320-420° C.; (2) spinning the wheel rim at a spinning temperature of 260-360° C. after forging, and finally the magnesium alloy wheel hub is obtained. The die is a die for forming bars, plates, tubes, wires or profiles.

The present invention is characterized in that: grain refinement can be generally adopted in the magnesium alloy, and quantity and size of precipitated strengthening phase in the alloy can by adjusted to improve the room temperature strength and plasticity of the alloy, such as optimizing the alloy texture, etc.

The technical principle of the present invention is that: low Al and high Mn in alloying elements, Al—Mn precipitated phase is obtained during homogenization of alloy, Al—Mn precipitated phase can pin the grain boundary and inhibit the migration of grain boundary. Rare earth elements will segregate at the interface of Al—Mn precipitated phase, which can improve the morphology and distribution of AlMn phase during solidification, inhibit its coarsening during extruding and forging, and help to refine grain and enhance strength. Adding light rare earth can also achieve the purpose of refining Al—Mn particles.

In the present invention, Al: 2-3.0 wt. %: when the content of Al is less than 2 wt. %, the Al is completely solid-dissolved in the magnesium matrix, can not form a precipitated phase with Mn, and does not have a strengthening effect; when the content of Al is more than 3 wt. %, the Al element will be enriched at the grain boundary, which will hinder grain deformation. Many practices have proved that materials with high Al content are prone to fracture during spinning.

In the present invention, Zn: 0.5-1.0 wt. %; an appropriate amount of Zn will combine with Al, Ce and La to form a precipitated phase with higher strengthening effect.

In the present invention, Mn: 0.3-0.5 wt. %; when the content of Mn is less than 0.3 wt. %, the amount of formed Mn-rich phase is small, which is not enough to hinder the growth of grains and improving the strength is limited; when the content of Mn is more than 0.5 wt. %, the formed Mn-rich phase is easy to segregate and cause cracking.

In the present invention, Ce: 0.15-0.3 wt. %; La: 0.05-0.1 wt. %; the addition of these two light rare earth elements is due to the fact that Ce and La atoms dissolved in magnesium alloy matrix tend to segregate at the interface of nano-scale Mn-rich precipitated phase due to the large difference between atomic size and Mg atom size, thus reducing the free energy. The occurrence of segregation can effectively inhibit the coarsening of nano-scale Mn-rich phase during extruding and forging. It is beneficial to enhance the grain refinement of nano-scale Mn-rich phase.

In the present invention, the deformed magnesium alloy material is finally obtained and the magnesium alloy wheel hub is prepared by forging and spinning process. For the wheel rim, the tensile yield strength of wheel rim at room temperature reaches 190 MPa, the tensile strength reaches 280 MPa, and the elongation rate is over 15.8%.

The magnesium alloy wheel hub manufactured by the conventional Al—Zn—Mn alloy (AZ31 alloy: Al: 2.5-3.5 wt. %; Zn: 0.6-1.4%; Mn: 0.12-1.0%) by means of the same forging and spinning process has poor quality stability, and transverse micro-cracks occur in wheel rims of some wheel hubs. For wheel rims of uncracked wheel hubs, the tensile yield strength at room temperature reaches 133 MPa, yield strength is 242 MPa and elongation is 8.7%.

Three alloy compositions, Mg-2Al-0.7Zn-0.5Mn-0.3Ce-0.1La (wt. %) (Alloy 1), Mg-2.6Al-0.9Zn-0.36Mn-0.2Ce-0.05La (wt. %) (Alloy 2) and Mg-2.9Al-0.6Zn-0.4Mn-0.2Ce-0.05La (wt. %) (Alloy 3), are selected as typical examples. According to the technical solution of the invention, the pure Mg (99.8 wt %) ingots, pure Al (99.9 wt %) ingots, pure Zn (99.9 wt %) ingots, AlMn master alloys, Mg-15Ce-10La (the actual detection content of Ce is 15.35 wt %, the actual detection content of La is 9.19 wt %) master alloys and Mg-30Ce (the actual detection content of La is 30.02 wt %) master alloys are taken as the alloying raw materials and smelted to prepare low-cost magnesium alloy ingot; the blank after stress-relieving and peeling is put into an induction heating furnace and quickly heated to the extrusion temperature of 280° C., and then the magnesium alloy blank is deformed and processed into bars by extruding, with the extrusion speed of 3m/min and the extrusion ratio of 2, and air-cooling the extruded bars; then, the material is forged and spun to be processed into a magnesium alloy wheel hub, and the mechanical properties of the wheel rim on the wheel hub are tested simultaneously. See Table 1 for the test results of room temperature mechanical properties of the embodiment and comparative example AZ31.

Embodiment 1: The Mg-2Al-0.7Zn-0.5Mn-0.3Ce-0.1La (wt %) alloy composition ratio is selected to form magnesium alloy, and the preparation method comprises the following steps.

Batching: using pure Mg ingots, pure Al blocks, pure Zn blocks, AlMn master alloys, Mg—Ce master alloys and Mg—Ce master alloys as raw materials, and batching according to the above target compositions.

Smelting: putting the pure Mg ingot into the crucible of the smelting furnace, setting the furnace temperature at 700-730° C. and keeping it, adding the pure Al block and pure Zn block preheated to 50-80° C. into magnesium solution after melting, then raising the smelting temperature to 760° C., adding the AlMn master alloy, Mg—Ce—La master alloy and Mg—Ce master alloy preheated to 50-80° C. into magnesium solution respectively, and keeping the temperature for 15 minutes, then stirring for 5 minutes, introducing the high-purity Ar gas for refining and degassing, and adjusting and controlling the temperature at 720° C. and keeping for 8 minutes; the smelting process is carried out under the protection of a mixed gas of $CO_2/SF_6$.

Pouring: removing the surface scum, pouring the magnesium alloy melt into corresponding die to prepare the as-cast magnesium alloy; the pouring temperature is controlled above 680° C., and the pouring process does not require gas protection.

Stress-relief treatment: keeping the temperature at 300° C. for 10h, and then air-cooling.

The stress-relieving ingot obtained in the previous step is cut into corresponding blanks and peeled.

(5) Extruding and deforming: heating the blank obtained in the previous step to 380° C. within 30 minutes, then putting the blank into a die for deforming; the extrusion speed is 4 m/min, air cooling is carried out after deforming, and the plastic magnesium alloy material is finally obtained.

The preparation of the wheel from the magnesium alloy material comprises forging and spinning: (1) forging the shaped magnesium alloy material described in the previous step on 6000-tons forging equipment at a forging temperature of 380° C.; (2) spinning the wheel rim at a spinning temperature of 360° C. after forging, and the magnesium alloy wheel hub is finally obtained.

Figure 2:
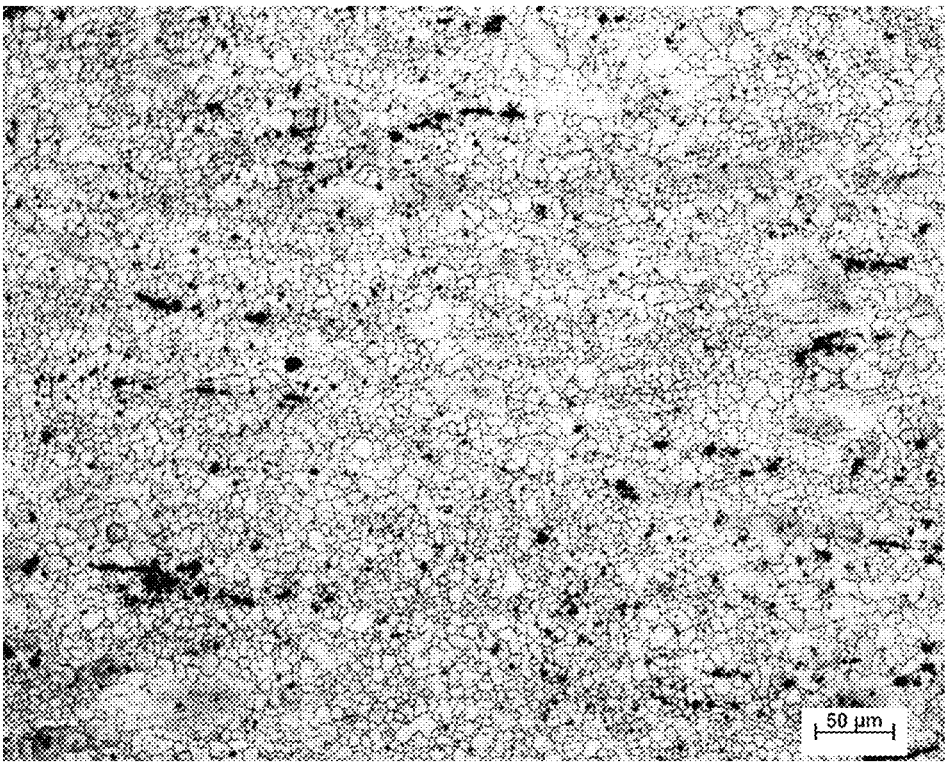
FIG. 2 is a microstructure of embodiment 1 parallel to the extrusion direction.
Figure 3:
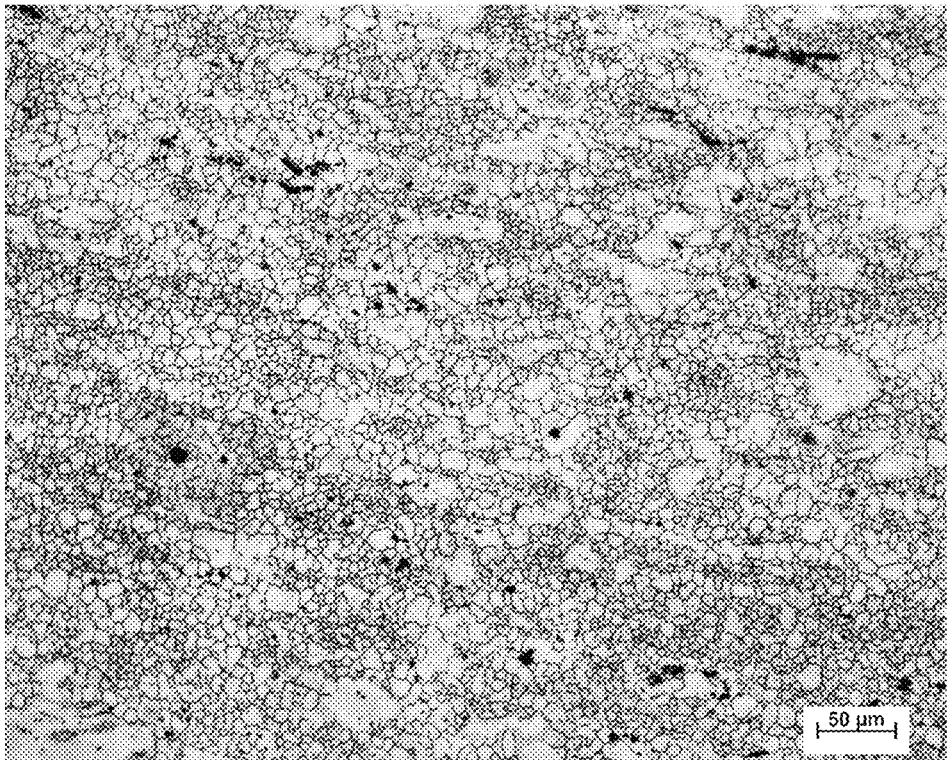
FIG. 3 is a microstructure of embodiment 2 parallel to the extrusion direction.

A sample with a length of 70 mm is cut from the wheel rim part of the wheel hub obtained in embodiment 1, and is processed into a round bar-shaped tensile sample with a diameter of 5 mm and a gauge length of 32 mm for tensile test. The axial direction of the round bar of the sample is the same as the extrusion streamline direction of the material. Measurement result of the magnesium alloy is that the tensile strength is 280 MPa, the yield strength is 190 MPa, and the elongation is 15.8%, as shown in Table 1. The magnesium alloy obtained in the embodiment has both high strength and high elongation. A typical tensile curve of the magnesium alloy obtained in the embodiment is shown in FIG. 1. FIG. 2 shows the microstructure morphology of Mg-2Al-0.7Zn-0.5Mn-0.3Ce-0.1La (wt %) magnesium alloy prepared in the embodiment parallel to the extrusion direction. It can also be seen from the metallographic diagram that the alloy undergoes complete dynamic recrystallization during spinning, and the grain size is about 8 μm.

Embodiment 2: The Mg-2.6Al-0.9Zn-0.36Mn-0.2Ce-0.05La (wt %) alloy composition ratio is selected to form magnesium alloy, and the preparation method comprises the following steps.

Batching: using the pure Mg ingot, pure Al block, pure Zn block, AlMn master alloy, Mg—Ce master alloy and Mg—La master alloy as raw materials, batching according to the above target compositions.

Smelting: putting the pure Mg ingot into the crucible of the smelting furnace, setting the furnace temperature at 730° C. and keeping it, after melting, adding the pure Al block and pure Zn block preheated to 50-80° C. into magnesium solution, then raising the smelting temperature to 760° C., adding the AlMn master alloy, Mg—Ce—La master alloy and Mg—Ce master alloy preheated to 50-80° C. into magnesium solution respectively, and keeping the temperature for 15 minutes, then stirring for 5 minutes, introducing high-purity Ar gas for refining and degassing treatment, and adjusting and controlling the temperature at 720° C. and keeping the temperature for 8 minutes; The smelting process is carried out under the protection of a mixed gas of $CO_2/SF_6$.

Pouring: removing the surface scum, pouring the magnesium alloy melt into a corresponding die to prepare the as-cast magnesium alloy; the pouring temperature is controlled above 680° C., and the casting process does not require gas protection.

Stress-relief treatment: keeping the temperature at 300° C. for 10h firstly, then air cooling, and the heating and heat preservation process of stress-relieving treatment does not need gas protection.

The ingot after solution treatment obtained in the previous step is cut into corresponding blanks and peeled them.

(5) Extruding and deforming: heating the blank obtained in the previous step to 300° C. within 30 minutes, and then putting into a die for deforming; extrusion speed is 5 m/min, air cooling is carried out after deforming, and the plastic magnesium alloy material is finally obtained.

The preparation of the wheel from the magnesium alloy material comprises forging and spinning: (1) forging the shaped magnesium alloy material described in the previous step on 6000-tons forging equipment at a forging temperature of 370° C.; (2) spinning the wheel rim at a spinning temperature of 350° C. after forging, and finally the magnesium alloy wheel hub is obtained.

A sample with a length of 70 mm is cut from the wheel rim part of the wheel hub obtained in embodiment 2, and is processed into a round bar-shaped tensile sample with a diameter of 5 mm and a gauge length of 32 mm for tensile test. The axial direction of the round bar of the sample is the same as the metal streamline direction of the material. Measurement result of the magnesium alloy in the present invention is that the tensile strength is 270.3 MPa, the yield strength is 172.1 MPa, and the elongation is 11.9%, as shown in Table 1. The magnesium alloy obtained in the embodiment has both high strength and high elongation. A typical tensile curve of the magnesium alloy obtained in the embodiment is shown in FIG. 1. FIG. 2 shows the microstructure morphology of Mg-2.6Al-0.9Zn-0.36Mn-0.2Ce-0.05La (wt %) magnesium alloy prepared in this example parallel to the extrusion direction. It can also be seen from the metallographic diagram that the alloy undergoes complete dynamic recrystallization during spinning, and the grain size is about 12 μm.

Embodiment 3: The Mg-2.9Al-0.6Zn-0.4Mn-0.2Ce-0.05La (wt %) alloy composition ratio is selected to form magnesium alloy, and the preparation method comprises the following steps.

1) Batching: using the pure Mg ingot, pure Al block, pure Zn block, AlMn master alloy, Mg—Ce—La master alloy and Mg—Ce master alloy as raw materials, batching according to the above target compositions.

2) Smelting: putting the pure Mg ingot into the crucible of the smelting furnace, setting the furnace temperature at 730° C. and keeping it, adding the pure Al block and pure Zn block preheated to 50-80° C. into magnesium solution after melting, then raising the smelting temperature to 760° C., adding the AlMn master alloy, Mg—Ce—La master alloy and Mg—Ce master alloy preheated to 50-80° C. into magnesium solution respectively, and keeping the temperature for 15 minutes, then stirring for 5 minutes, introducing the high-purity Ar gas for refining and degassing, and adjusting and controlling the temperature at 720° C. and keeping the temperature for 8 minutes; the smelting process is carried out under the protection of a mixed gas of $CO_2/SF_6$.

3) Pouring: removing the surface scum, pouring the magnesium alloy melt into a corresponding die to prepare the as-cast magnesium alloy; the pouring temperature is controlled above 680° C., and the casting process does not require gas protection.

4) Stress relief treatment: keeping the temperature at 300° C. for 10h firstly, and then air cooling; the heating and heat preservation process of stress-relieving treatment does not need gas protection.

The ingot after solution treatment obtained in the previous step is cut into corresponding blanks and peeled them.

5) Extruding and deforming: heating the blank obtained in the previous step to 310° C. within 30 minutes, and putting the blank into a die for deforming; extrusion speed is 6 m/min, air cooling is carried out after deforming, and finally the plastic magnesium alloy material is obtained.

The preparation of the wheel from the magnesium alloy material comprises forging and spinning: (1) forging the shaped magnesium alloy material described in the previous step on 6000-tons forging equipment at a forging temperature of 390° C.; (2) spinning the wheel rim at a spinning temperature of 360° C. after forging, and finally the magnesium alloy wheel hub is obtained.

A sample with a length of 70 mm is taken from the wheel rim of the wheel hub obtained in embodiment 3, and the sample is processed into a round bar-shaped tensile sample with a diameter of 5 mm and a gauge length of 32 mm, and the axial direction of the sample round bar is the same as the metal streamline direction of the material. Measurement result of the magnesium alloy in the present invention is that the tensile strength is 273 MPa, the yield strength is 178 MPa, and the elongation is 11.4%.

Figure 4:
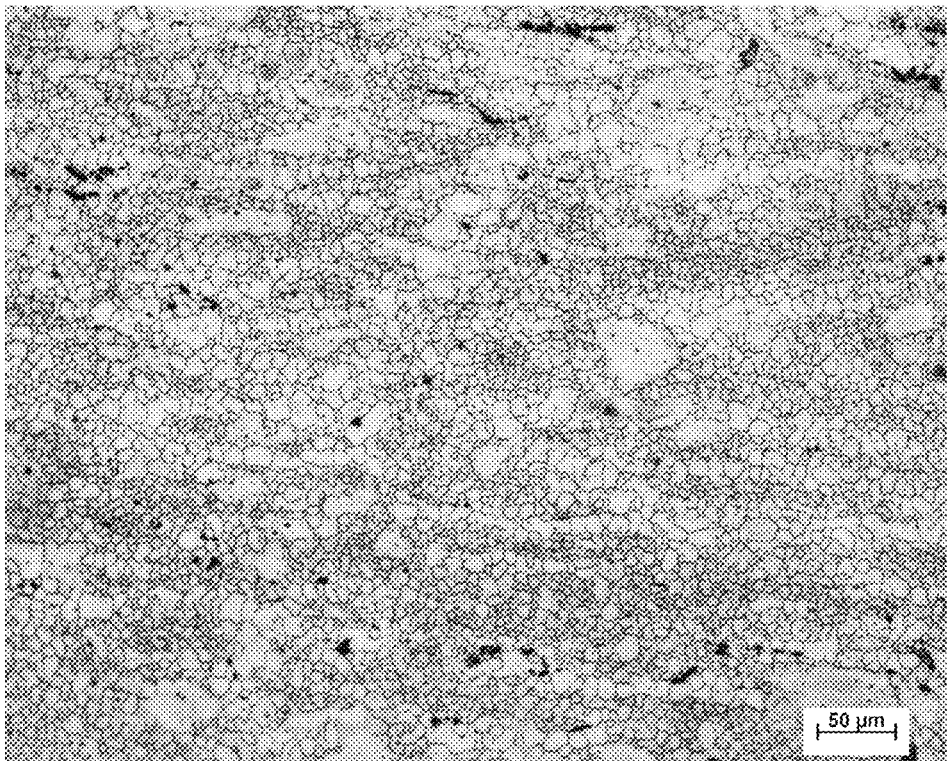
FIG. 4 is a microstructure of embodiment 3 parallel to the extrusion direction.

As shown in Table 1, the magnesium alloy obtained in the embodiment has both high strength and medium elongation. A typical tensile curve of the magnesium alloy obtained in the embodiment is shown in FIG. 1. FIG. 4 shows a microstructure morphology of Mg-2.9Al-0.6Zn-0.4Mn-0.2Ce-0.05La (wt %) magnesium alloy prepared in this embodiment parallel to the extrusion direction. It can also be seen from the metallographic diagram that its characteristics are similar to those of embodiments 1 and 2, and the alloy undergoes complete recrystallization during extruding, with a grain size of about 15 μm.

Figure 5:
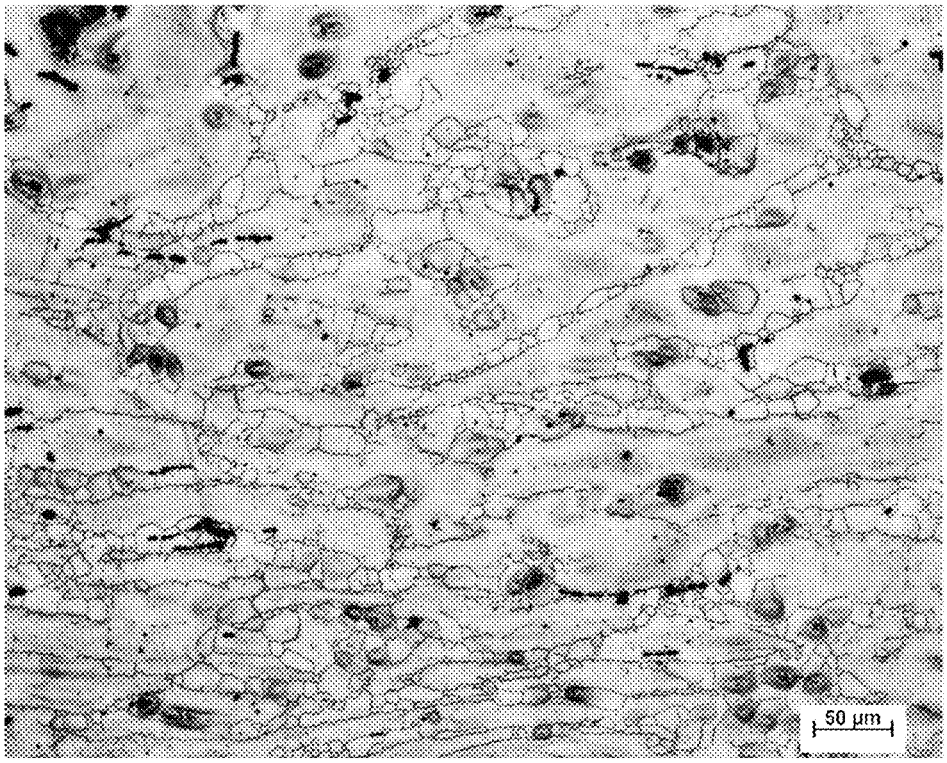
FIG. 5 is a microstructure of a comparative example parallel to the extrusion direction.
Figure 6:
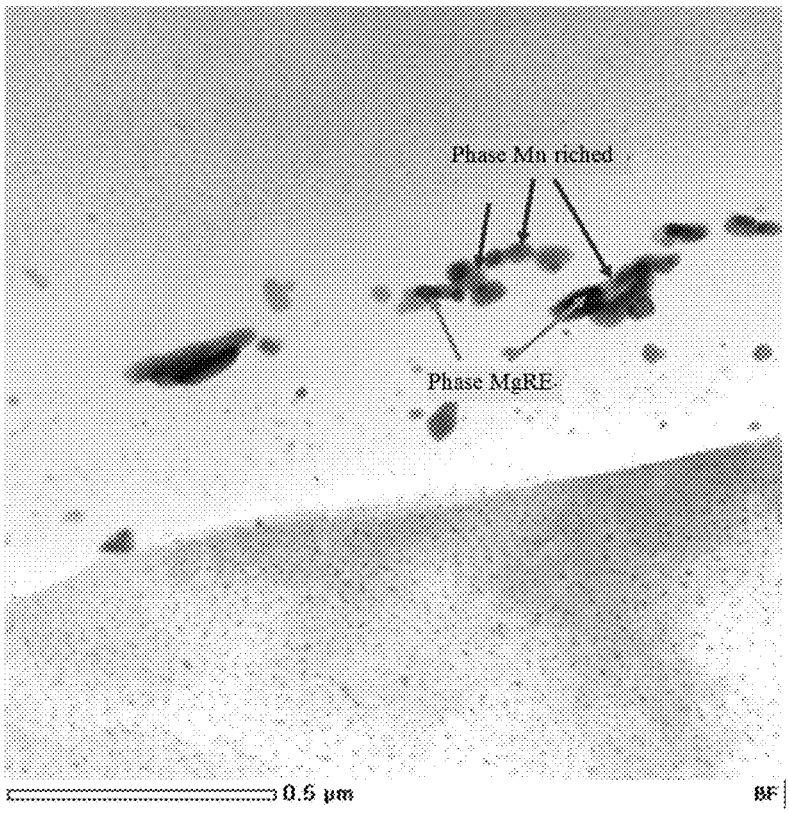
FIG. 6 shows the TEM structure of the alloy of embodiment 1.

FIG. 5 is a TEM microstructure diagram of an alloy in the embodiments. From the diagram, it can be found that MgRE phase exists near the nano-scale Mn-rich phase, which will hinder the coarsening of the nano-scale Mn-rich phase in the subsequent heat treatment. Meanwhile, it can be observed that there are more nano-scale precipitates in the alloy, which occur prematurely, thus improving the room temperature plasticity of the alloy.

The comparative example is a commercial AZ31 magnesium alloy: Mg-2.8Al-0.9Zn-0.3Mn (wt %) magnesium alloy. In the comparative example (obtained under the same forging and spinning conditions as in embodiment 1), a typical stress-strain curve in a tensile test is shown in FIG. 1. Its tensile strength is 242 MPa, its yield strength is 133 MPa, and its elongation is 8.7%, as shown in Table 1. By comparison, it can be seen that the room temperature strength and elongation of the new magnesium alloy in the present invention are significantly improved compared with the comparative alloy. It has the same effect as the alloy after adding a large amount of rare earth elements and large plastic deformation, and is a new low-cost and high-strength magnesium alloy material with high market competitiveness in the field of preparing magnesium alloy wheel hubs.

The raw materials and apparatus used in the above-mentioned embodiments are obtained by known ways, and the operation process used is mastered by those skilled in the art.

TABLE 1

Test results of mechanical properties at room temperature in embodiments and comparative example

| | Alloy composition (wt %) | Tensile strength MPa | Yield strength MPa | Elongation % |
|---|---|---|---|---|
| Embodiment 1 | Mg—2Al—0.7Zn—0.5Mn—0.3Ce—0.1La | 280 | 190 | 15.8 |
| Embodiment 2 | Mg—2.6Al—0.9Zn—0.36Mn—0.2Ce—0.07La | 270 | 172 | 11.9 |
| Embodiment 3 | Mg—2.9Al—0.6Zn—0.4Mn—0.2Ce—0.05La | 273 | 178 | 11.4 |
| Comparative example | AZ31 | 242 | 133 | 8.7 |

TABLE 2

Reliability Test Data Sheet

| Preparation process | 90-degree impact limit test (impact limit height) | Radial fatigue | Bending fatigue (heavy load) | Bending fatigue (light load) | 13-degree impact |
|---|---|---|---|---|---|
| Fabrication of Wheels with Traditional Materials | 12 mm | 2.8 million (limit) | 350,000 (limit) | 1.9 million (limit) | Qualified |

TABLE 2-continued

| Reliability Test Data Sheet | | | | | |
|---|---|---|---|---|---|
| Preparation process | 90-degree impact limit test (impact limit height) | Radial fatigue | Bending fatigue (heavy load) | Bending fatigue (light load) | 13-degree impact |
| Fabrication of Wheels with New Materials | 7.2 mm | 3.46 million (limit) | 470,000 (limit) | 3.34 million (limit) | Qualified |

The above are only preferred embodiments of the present invention and are not intended to limit the present invention. Any modifications, equivalents, modifications, etc. made within the spirit and principles of the present invention should be included in the scope of protection of the present invention.

What is claimed is:

1. A method for preparing a magnesium alloy for wheels, wherein the method comprises the following steps:

(1) batching, in mass percentage: Al: 2-3.0 wt. %; Zn: 0.5-1.0 wt. %; Mn: 0.3-0.5 wt. %; Ce: 0.15-0.3 wt. %; La: 0.05-0.1 wt. %, the balance is Mg for batching;

(2) smelting, putting a pure Mg ingot into a crucible of a smelting furnace, setting the furnace temperature at 700-730° C. and keeping the furnace temperature at 700-730° C., adding pure Al block and pure Zn block preheated to 50-80° C. into a magnesium solution after melting, then raising the smelting temperature to 760° C., and adding an Al—Mn master alloy, an Mg—Ce—La master alloy and an Mg—Ce master alloy preheated to 50-80° C. into the magnesium solution respectively; then raising the smelting temperature to 780° C., keeping the temperature for 5-15 minutes, then stirring for 3-10 minutes, introducing high-purity Ar gas for refining and degassing, adjusting and controlling temperature at 710° C.-730° C., and keeping the temperature for 2-10 minutes;

(3) pouring the solution obtained by the melting process into a first die to obtain the magnesium alloy, the pouring temperature is controlled above 680° C.;

(4) performing stress relief treatment on the magnesium alloy, keeping the temperature at 280-320° C. for 8-12 h, and then air cooling;

(5) extruding and deforming, heating the magnesium alloy with stress relieved to 250-380° C. within 30 minutes, then putting the magnesium alloy into a second die for deformation processing; the extrusion speed being 1 m/min-8 m/min, and air cooling after deformation processing.

2. The method for preparing a magnesium alloy for wheels according to claim 1, wherein the smelting process is carried out under the protection of a mixed gas of $CO_2$ and $SF_6$.

3. The method for preparing a magnesium alloy for wheels according to claim 2, wherein the composition volume ratio of a mixed gas of $CO_2$ and $SF_6$ is 50-100:1.

4. The method for preparing a magnesium alloy for wheels according to claim 1, wherein after the smelting is completed, surface scum is removed.

5. The method for preparing a magnesium alloy for wheels according to claim 1, wherein, after the stress relief treatment, processes of cutting into blanks and peeling are also included before extrusion.

6. The method for preparing a magnesium alloy for wheels according to claim 1, wherein the stirring in the smelting process comprises mechanical stirring and/or argon stirring.

7. The method for preparing a magnesium alloy for wheels according to claim 1, wherein the Al—Mn master alloy is an Al-20Mn master alloy, the Mg—Ce—La master alloy is a Mg-15Ce-10La master alloy, and the Mg—Ce master alloy is a Mg-30Ce master alloy.

* * * * *